US009993037B2

(12) United States Patent
Horndeski

(10) Patent No.: US 9,993,037 B2
(45) Date of Patent: Jun. 12, 2018

(54) POST-SURGICAL SUPPORT BRASSIERE

(71) Applicant: Gary Horndeski, League City, TX (US)

(72) Inventor: Gary Horndeski, League City, TX (US)

(73) Assignee: INNOVELLUM, LLC, Lake Forest, IL (US)

( * ) Notice: Subject to any disclaimer, the term of this patent is extended or adjusted under 35 U.S.C. 154(b) by 85 days.

(21) Appl. No.: 15/153,323

(22) Filed: May 12, 2016

(65) Prior Publication Data

US 2017/0006927 A1 Jan. 12, 2017

Related U.S. Application Data

(60) Provisional application No. 62/160,162, filed on May 12, 2015.

(51) Int. Cl.
*A41C 3/00* (2006.01)

(52) U.S. Cl.
CPC ..... *A41C 3/0064* (2013.01); *A41C 3/0007* (2013.01); *A41C 3/0028* (2013.01)

(58) Field of Classification Search
CPC ..... A41C 3/00; A41C 3/0057; A41C 3/0007; A41C 3/124; A41C 3/05; A41C 3/06
USPC ..... 450/41–45, 39
See application file for complete search history.

(56) References Cited

U.S. PATENT DOCUMENTS 2,701,879 A * 2/1955 Bennett ..... A41C 3/065 450/52
2,880,732 A * 4/1959 Smith ..... A41C 3/06 450/51
3,312,223 A * 4/1967 Wilson ..... A41C 3/124 450/45
5,527,202 A * 6/1996 Morgan ..... A41C 3/124 450/41
5,967,876 A * 10/1999 Kollmanthaler ..... A41C 3/0007 450/41
7,824,242 B2 * 11/2010 Perman ..... A41C 3/0007 450/41
8,747,185 B1 * 6/2014 Evans, Sr. ..... A44C 15/0045 450/41

* cited by examiner

*Primary Examiner* — Gloria Hale
(74) *Attorney, Agent, or Firm* — Patzik, Frank & Samotny Ltd.

(57) ABSTRACT

An article of clothing, such as a post-surgical support brassiere, may include a cup, a band configured to secure the cup to the body of a wearer of the article of clothing, and a rigid arcuate element having a lateral end and a central end and coupled to the cup so as to support the cup. The rigid arcuate element may be disposed under the cup so as to be adjustable relative to the cup, wherein the lateral end of the rigid arcuate element is adjustable so as to alter the tension applied to the body by the central end.

18 Claims, 5 Drawing Sheets

POST-SURGICAL SUPPORT BRASSIERE

CROSS-REFERENCE TO RELATED APPLICATIONS

This application claims the benefit of U.S. provisional patent application No. 62/160,162, filed May 12, 2015, the entirety of which is hereby incorporated by reference.

BACKGROUND a. Technical Field

The instant disclosure relates to articles of clothing, including brassieres, and in particular, the instant disclosure relates to a post-surgical support brassiere, along with other brassieres, that can be adjusted for more or less support purposes.

b. Background Art

A brassiere or bra is an undergarment configured and designed to support a woman's breasts. Although seemingly simple in design, a brassiere is much more complicated and a typical brassiere design may have over 20 individual parts, including bands, hooks, cups, lining, and straps. Many mass-produced brassieres are manufactured to fit a standard sized woman, and the design assumes that both of the woman's breasts are equally sized and symmetrical in shape.

Support brassieres typically utilize underwire support structures located beneath the inframammary skinfold of the breasts at the juncture of women's breasts and her front thoracic torso to shape and support the breasts.

However, known brassieres may not adequately support the breasts in the appropriate position for post-surgical or general support needs. Accordingly, known brassieres may not allow for optimum surgical outcomes. For example, known brassieres may not properly prevent symastia, may not properly prevent dislocation of tissue or implants, and may not properly define the width of breast cleavage for post-surgical healing in the proper position.

As such there is a need for a brassiere that improves upon known brassieres, including post-surgical brassieres, by providing improved definition of the width of breast cleavage, improved prevention of inferior lateral dislocation of breast tissue or implants, improved definition of the lateral edge of the breast, and improved prevention of symastia following an implant procedure, among other benefits.

The foregoing is intended only to illustrate the present technical field and background art and should not be taken as a limitation or disavowal of claim scope.

BRIEF SUMMARY

In accordance with the present disclosure, an improved apparatus and method is disclosed for an article of clothing, such as a brassiere, for use as a post-surgical support brassiere, or any other brassiere, that can be adjusted for additional support purposes, as necessary.

An exemplary embodiment of article of clothing, such as a brassiere, may include a cup, a band configured to secure the cup to the body of a wearer of the article of clothing, and a rigid arcuate element having a lateral end and a central end and coupled to the cup so as to support the cup. The rigid arcuate element may be disposed under the cup so as to be adjustable relative to the cup, wherein the lateral end of the rigid arcuate element is adjustable so as to alter the tension applied to the body by the central end.

A brassiere according to the present disclosure may improve upon known brassieres, including post-surgical brassieres, by providing improved definition of the width of breast cleavage, improved prevention of inferior lateral dislocation of breast tissue or implants, improved definition of the lateral edge of the breast, and improved prevention of symastia following an implant procedure, among other benefits.

Additional objectives and advantages of the present disclosure will become apparent to one having ordinary skill in the art after reading the specification in light of the drawing figures, however, the spirit and scope of the present invention should not be limited to the description of the embodiments contained herein.

DETAILED DESCRIPTION

As stated herein, the objective of the present disclosure is to provide a detailed description of an apparatus and methods for an article of clothing, such as a brassiere, for use as a post-surgical support brassiere, or any other brassiere, that can be adjusted for additional support purposes, as necessary. As such, in the foregoing discussion, and in particular, the description of the preferred embodiment herein, is intended only to illustrate and explain these objectives and should not be taken as a disavowal of claim scope.

Figure 1:
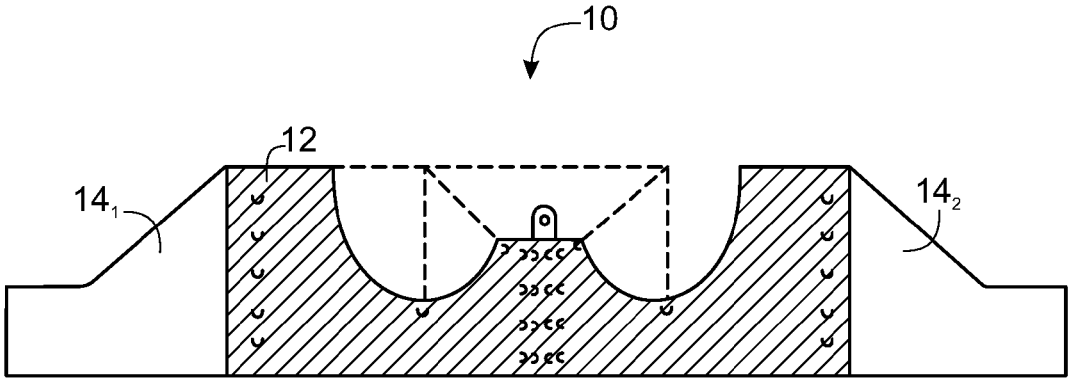
FIG. 1 is a schematic front view of an exemplary embodiment of a brassiere according to the present disclosure.
Figure 2:
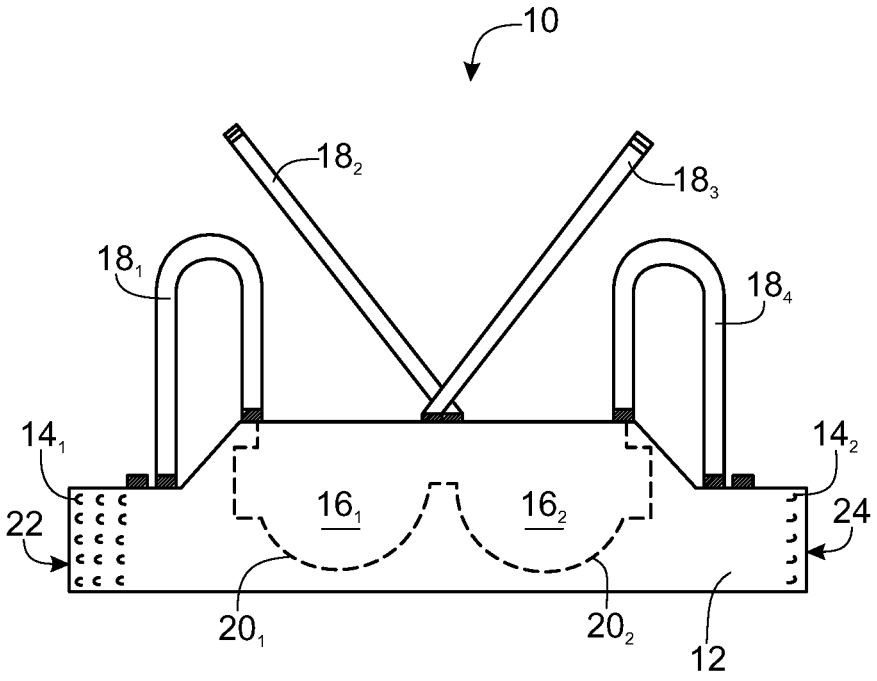
FIG. 2 is a schematic front view of an exemplary embodiment of a brassiere according to the present disclosure.

Referring to the drawings, wherein like reference numerals refer to the same or similar features in the various views, FIGS. 1 and 2 are schematic front views of an exemplary embodiment of a brassiere 10 according to the present disclosure. The brassiere 10 may find use after a surgical procedure, such as a breast augmentation or reduction. Of course, the brassiere 10 is not limited to post-surgical use; instead, a brassiere 10 according to the present disclosure may find use in everyday wear for certain individuals and in certain embodiments.

With reference to FIGS. 1 and 2, the brassiere 10 may include an elastic body or envelope 12 extending laterally and including two lateral bands $\mathbf{14}_1$, $\mathbf{14}_2$, two cups $\mathbf{16}_1$, $\mathbf{16}_2$ (which may be referred to herein collectively as the cups 16 or individually as a cup 16), two or more shoulder straps (four such shoulder straps $\mathbf{18}_1$, $\mathbf{18}_2$, $\mathbf{18}_3$, $\mathbf{18}_4$ are illustrated in FIG. 2, which may be referred to herein collectively as the straps 18 or individually as a strap 18) and two arcuate rigid elements $\mathbf{20}_1$, $\mathbf{20}_2$ (illustrated partially and in phantom in FIG. 2 and which may be referred to herein collectively as the rigid arcuate elements 20 or individually as a rigid arcuate element 20). In addition, a plurality of complementary hooks 22 and loops 24 or other fasteners may be provided on the bands $\mathbf{14}_1$, $\mathbf{14}_2$ for securing the brassiere 10 to the body of the wearer, as understood by one of ordinary skill in the art.

The straps may include two or more sets of straps 18 extending straight vertically or in a diagonal (e.g., such that two diagonal straps 18 cross each other, such as straps $\mathbf{18}_2$, $\mathbf{18}_3$ of FIG. 2) configuration. The straps 18 may be adjustable with conventional adjustable sliders. The straps may compress the midline of the chest so as to increase the depth of cleavage and reduce or eliminate symastia, but may not compress the upper inner pole of the breast, in an embodiment.

The elastic envelope 12 may be configured to adjustably encircle a wearer's torso and may support the cups 16 and the rigid arcuate elements 20. The elastic envelope 12 may be coupled with the straps 18 so as to be vertically supported by the straps 18. Numerous coupling points may be provided on the elastic envelope for optionally attaching the straps 18 to different points on the elastic envelope 12, or for removing one or more straps 18 entirely.

In an embodiment, the elastic envelope 12 may include one or more pockets for receiving a rigid arcuate element and for maintaining the position of the rigid arcuate element with respect to a cup 16 so that the rigid arcuate element 20 may support the cup 16. For example, in an embodiment, the elastic envelope 12 may include a pocket under each cup 16. In an embodiment, the elastic envelope 12 may include a single continuous pocket extending under or about both cups 16 to receive a single monolithic rigid element having two arcuate portions.

One, two, or more rigid arcuate elements 20 may be provided to support the cups 16 and to properly position and shape the breasts, in an embodiment. For example, the rigid arcuate elements 20 may be configured to properly position and shape the breasts for post-surgical recovery. Each rigid arcuate element 20 may be configured for insertion into a pocket provided in the elastic envelope 12, in an embodiment. Additionally or alternatively, a rigid arcuate element 20 may be configured to be coupled to the elastic envelope 12 in some other fashion. A rigid arcuate element 20 may comprise a metallic or polymer wire, bar, or similar structure, in an embodiment.

Each rigid arcuate element 20 may be coupled with the elastic envelope 12 in such a fashion as to be adjustable relative to the envelope 12, to the cups 16, and/or to the wearer's body. For example, each rigid arcuate element 20 may be configured for adjustment to one of two or more positions, with the different positions providing different levels of support, different shapes for the breasts, different positions for the breasts, etc. Such adjustment is illustrated in and described with respect to FIGS. 3-8 for two separate embodiments of a rigid arcuate element.

Figure 3:
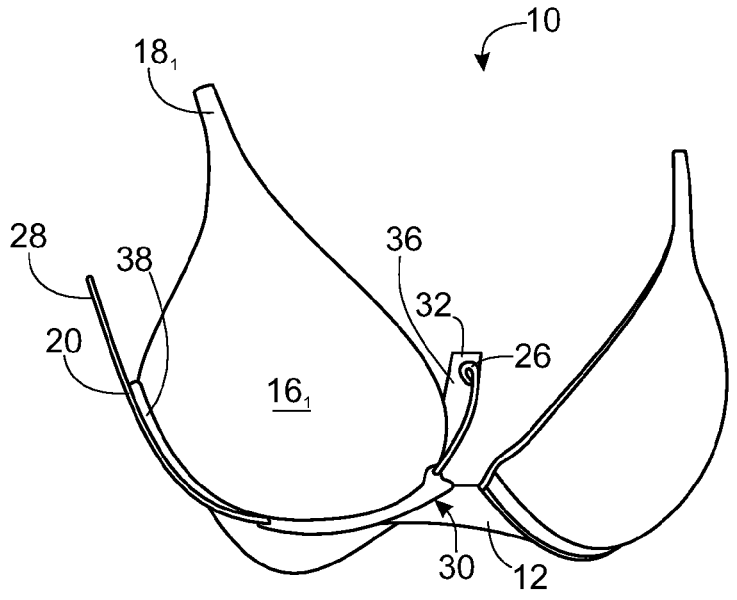
FIG. 3 is a front view of an exemplary embodiment of a brassiere according to the present disclosure, disposed on a human model.

FIG. 3 is a front view of an exemplary embodiment of a brassiere 10 according to the present disclosure, disposed on a human model. FIG. 3 illustrates an exemplary rigid arcuate element 20 in the form of a metallic wire having a central end 26 terminating in the wearer's breastplate and a lateral end 28 extending to the wearer's side. The rigid arcuate element extends below the cup in a pocket 30 provided by the elastic envelope 12. The rigid arcuate element 20 may be rotatable within the pocket 30, such that rotatable adjustment of the rigid arcuate element 20 causes the central end 26 of the rigid arcuate element 20 to move towards or away from the wearer's breastplate or, if the central end 26 is in contact with the wearer, to increase or decrease the amount of pressure applied to the wearer's breastplate by the central end 26 of the rigid arcuate element 20.

This adjustment may provide varying amounts of projection, upper pole fullness, and areola projection, in an embodiment. The lateral end 28 of the rigid arcuate element 20 may be secured to the elastic envelope 12 at a desired position with one or more fasteners (not shown), in an embodiment.

As illustrated in FIG. 3, an interface layer 32 may be provided adjacent to and between the rigid arcuate element 20 and the wearer's body. The interface layer 32 may comprise a lateral end 38 and a central end 36 that correspond with the lateral end 28 and the central end 26 of the rigid arcuate element 20, in an embodiment. The interface layer 32 may be provided between the elastic envelope 12 and the wearer's body, in an embodiment. Additionally or alternatively, the interface layer 32 may be provided between the rigid arcuate element 20 and the elastic envelope 12, in an embodiment.

Similar to the rigid arcuate element 20 described herein in association with FIGS. 3-6, in an embodiment, two separate interface layers 32 may be provided, one associated with each cup 16. Such separate interface 32 layers may separately apply pressure to the breastplate of the wearer depending on the rotatable adjustment of each rigid arcuate element 20, if the rigid arcuate elements 20 are separate and adjusted differently relative to each other.

Further, the two interface layers 32 described above may be connected at their respective central ends 36 to create a single continuous, monolithic interface layer. Regardless of separate or continuous configuration, the interface layer may be or may include a firm material, such as Kevlar™ or a similar metallic material, or may be or include a fabric or other textile, in an embodiment.

Figure 4:
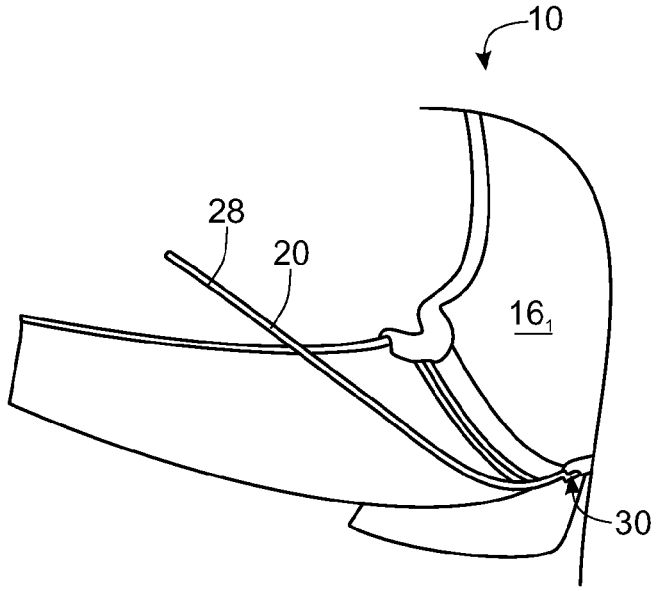
FIG. 4 is a side view of the brassiere of FIG. 3, with an adjustable arcuate element disposed in a first position.
Figure 5:
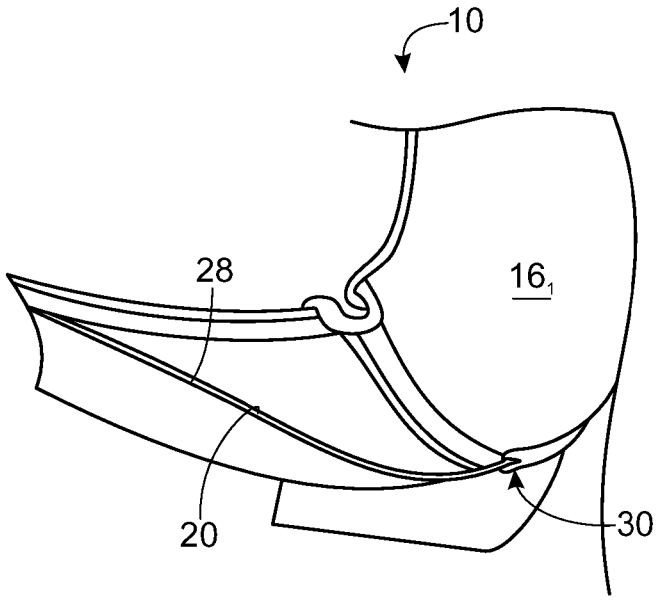
FIG. 5 is a side view of the brassiere of FIG. 3, with the adjustable arcuate element disposed in a second position.
Figure 6:
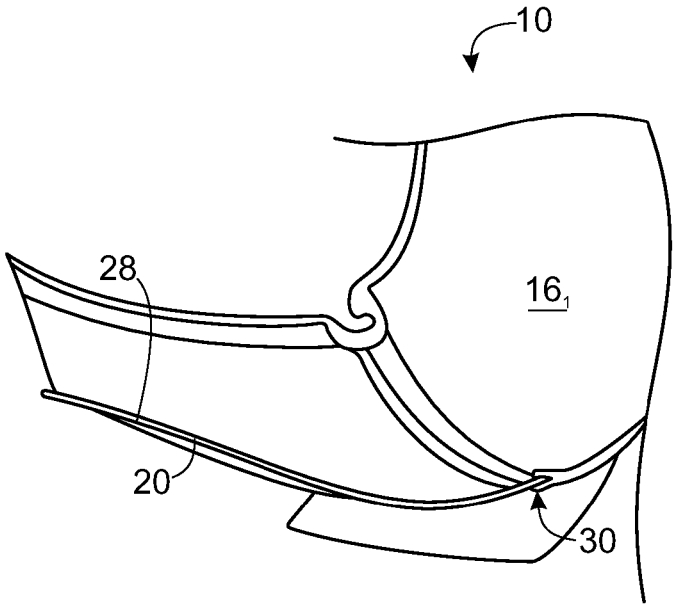
FIG. 6 is a side view of the brassiere of FIG. 3, with the adjustable arcuate element disposed in a third position.

FIG. 4 is a side view of the brassiere 10 of FIG. 3, with the arcuate element 20 disposed in a first position. FIG. 5 is a side view of the brassiere 10 with the arcuate element 20 disposed in a second position. FIG. 6 is a side view of the brassiere 10 with the adjustable arcuate element 20 disposed in a third position. The three different positions illustrated in FIGS. 4, 5, and 6 are achieved through rotation of the arcuate element 20 within the pocket 30.

The lateral portion 28 of the rigid arcuate element 20 (i.e., the portion visible in FIGS. 4-6) may provide improved prevention of inferior lateral dislocation of tissue or an implant. The lateral portion 28 of the rigid arcuate element 20 may additionally define the lateral edge of the breast and create an axillary hollow.

The three different positions illustrated in FIGS. 4, 5, and 6 may provide three different amounts of pressure of the central end 26 of the arcuate element 20 (not shown in FIGS. 4, 5, and 6) on the wearer's breastbone, as well as three different positions for preventing lateral displacement of tissue or an implant. The present disclosure is not limited to the three positions as shown and disclosed herein as the preferred embodiment, but may include more or less positions, as necessary, and can also be continuously variable, as opposed to specific locations.

In an embodiment, two separate rigid arcuate elements $\mathbf{20}_1$, $\mathbf{20}_2$ may be provided, one associated with each cup 16. Such separate rigid arcuate elements $\mathbf{20}_1$, $\mathbf{20}_2$ may be separately adjustable, in an embodiment, and may separately apply pressure to the breastplate of the wearer. The rigid arcuate elements $\mathbf{20}_1$, $\mathbf{20}_2$ (i.e., the center end portions 26 of each) may be adjusted relative to each other to define a desired cleavage and central separation.

Figure 7:
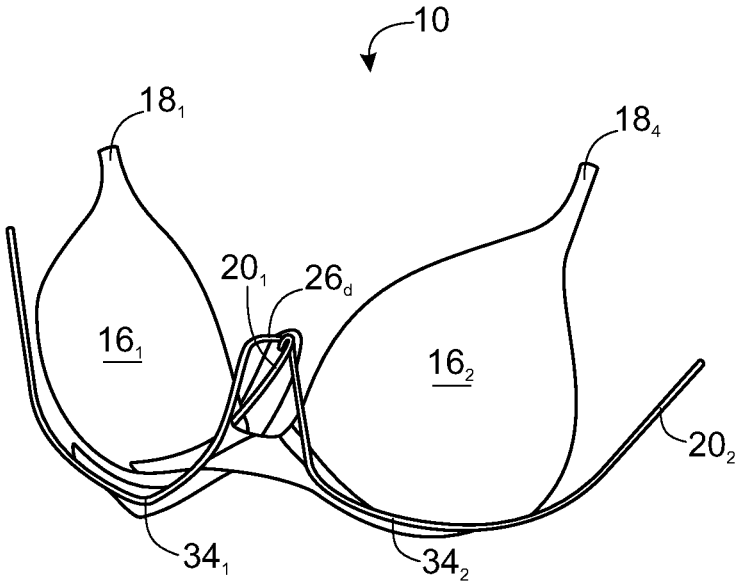
FIG. 7 is a front view of an exemplary embodiment of a brassiere according to the present disclosure and having a monolithic dual-arc rigid arcuate element in a first position.
Figure 8:
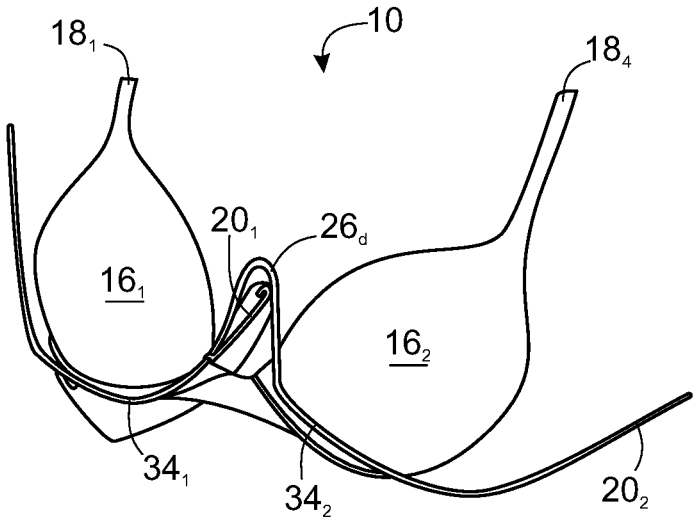
FIG. 8 is a front view of the brassiere of FIG. 7 with the monolithic dual-arc rigid arcuate element in a second position.

FIG. 7 is a front view of an exemplary embodiment of a brassiere 10 according to the present disclosure and having a continuous, monolithic dual-arc rigid arcuate element $\mathbf{20}_d$ in a first position. A single rigid arcuate element $\mathbf{20}_1$ is also illustrated in FIG. 7 for comparison. FIG. 8 is a front view of the brassiere 10 of FIG. 7 with the monolithic dual-arc rigid arcuate element $\mathbf{20}_d$ in a second position. The monolithic rigid element $\mathbf{20}_d$ may function similarly to the separate rigid arcuate elements $\mathbf{20}_1$, $\mathbf{20}_2$ described above, but may allow for only a single position common to both breasts.

The central portion $\mathbf{26}_d$ of the monolithic rigid element may include a junction of two arcuate portions $\mathbf{34}_1$, $\mathbf{34}_2$, which central portion $\mathbf{26}_d$ may apply variable pressure to the wearer's breastplate (with a position of greater pressure illustrated in FIG. 8). The central portion $\mathbf{26}_d$ of the dual-arc rigid arcuate element $\mathbf{20}_d$ may define a separation between the two arcuate portions $\mathbf{34}_1$, $\mathbf{34}_2$, which separation may be adjustable, as also shown in FIGS. 7 and 8.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment.

Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional. Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. An adjustable post-surgical support brassiere, comprising:

a first cup;

a first band portion configured to secure the first cup to a wearer of the adjustable post-surgical support brassiere;

a first interface layer located on said first band portion, said first interface layer having a first interface layer lateral end and a first interface layer central end; and a first rigid arcuate element having a first lateral end and a first central end, said first rigid arcuate element coupled to the first cup so as to support the first cup, the first rigid arcuate element located adjacent to said first interface layer and disposed under the first cup so as to be adjustable by rotating the first lateral end of the first rigid arcuate element relative to the first cup, wherein the first lateral end of the first rigid arcuate element is adjustable so as to alter a tension applied to the wearer by the first central end of the first rigid arcuate element due to said rotation.

2. The adjustable post-surgical support brassiere of claim 1, further comprising:

a second cup;

a second band portion configured to secure said second cup to said wearer of the adjustable post-surgical support brassiere;

a second interface layer having a second interface layer lateral end and a second interface layer central end; and a second rigid arcuate element having a second lateral end and a second central end, said second rigid arcuate element coupled to the second cup so as to support the second cup, the second rigid arcuate element located adjacent to said second interface layer and disposed under the second cup so as to be adjustable by rotating the second lateral end of the second rigid arcuate element relative to the second cup, wherein the second lateral end of the second rigid arcuate element is adjustable so as to alter a second tension applied to the wearer by the second central end of the second rigid arcuate element due to said rotation.

3. The adjustable post-surgical support brassiere of claim 2, wherein the first central end of the first rigid arcuate element is joined at the second central end of the second rigid arcuate element.

4. The adjustable post-surgical support brassiere of claim 1, wherein the first arcuate element comprises a metallic or polymer wire or bar.

5. The adjustable post-surgical support brassiere of claim 2, wherein the second arcuate element comprises a metallic or polymer wire or bar.

6. The adjustable post-surgical support brassiere of claim 3, wherein the first arcuate element and the second arcuate element comprise a continuous, monolithic piece of material.

7. The adjustable post-surgical support brassiere of claim 6, wherein when said first lateral end of the first rigid arcuate element and said second lateral end of the second rigid arcuate element are adjusted, the tension altered and applied to the wearer by the first central end of the first rigid arcuate element and the second central end of the second rigid arcuate element is the same.

8. The adjustable post-surgical support brassiere of claim 2, wherein the first interface layer central end of the first interface layer is joined to the second interface layer central end of the second interface layer.

9. The adjustable post-surgical support brassiere of claim 5, wherein the first interface layer and the second interface layer comprise a continuous, monolithic piece of material.

10. A method of adjusting an adjustable post-surgical support brassiere, said adjustable post-surgical support brassiere comprising a first cup, a first band portion configured to secure the first cup to a wearer, a first interface layer located on said first band portion, said first interface layer having a first interface layer lateral end and a first interface layer central end, and a first rigid arcuate element having a first lateral end and a first central end, said first rigid arcuate element coupled to the first cup so as to support the first cup, the first rigid arcuate element located adjacent to said first interface layer and disposed under the first cup so as to be adjustable by rotating the first lateral end of the first rigid arcuate element relative to the first cup, comprising the steps of:

placing said adjustable post-surgical support brassiere on said wearer, such that a first breast of said wearer is generally located inside said first cup;

altering a tension of said adjustable post-surgical support brassiere on said wearer by adjusting the first lateral end of the first rigid arcuate element, wherein said adjustment of said first lateral end alters the tension applied to the wearer by the first central end of the first rigid arcuate element.

11. The method of adjusting an adjustable post-surgical support brassiere of claim 10, further comprising a second cup, a second band portion configured to secure said second cup to said wearer, a second interface layer having a second interface layer lateral end and a second interface layer central end, and a second rigid arcuate element having a second lateral end and a second central end, said second rigid arcuate element coupled to the second cup so as to support the second cup, the second rigid arcuate element located adjacent to said second interface layer and disposed under the second cup so as to be adjustable by rotating the second lateral end of the second rigid arcuate element relative to the second cup, further comprising the steps of:

altering a second tension of said adjustable post-surgical support brassiere on said wearer by adjusting the second lateral end of the second rigid arcuate element, wherein said adjustment of said second lateral end alters the second tension applied to the wearer by the second central end of the second rigid arcuate element.

12. The method of adjusting an adjustable post-surgical support brassiere of claim 11, wherein the first central end of the first rigid arcuate element is joined at the second central end of the second rigid arcuate element.

13. The method of adjusting an adjustable post-surgical support brassiere of claim 10, wherein the first arcuate element comprises a metallic or polymer wire or bar.

14. The method of adjusting an adjustable post-surgical support brassiere of claim 11, wherein the second arcuate element comprises a metallic or polymer wire or bar.

15. The method of adjusting an adjustable post-surgical support brassiere of claim 12, wherein the first arcuate element and the second arcuate element comprise a continuous, monolithic piece of material.

16. The method of adjusting an adjustable post-surgical support brassiere of claim 15, wherein when said first lateral end of the first rigid arcuate element and said second lateral end of the second rigid arcuate element are adjusted, the tension altered and applied to the wearer by the first central end of the first rigid arcuate element and the second tension altered and applied to the wearer by the second central end of the second rigid arcuate element is the same.

17. The method of adjusting an adjustable post-surgical support brassiere of claim 11, wherein the first interface layer central end of the first interface layer is joined to the second interface layer central end of the second interface layer.

18. The method of adjusting an adjustable post-surgical support brassiere of claim 14, wherein the first interface layer and the second interface layer comprise a continuous, monolithic piece of material.

* * * * *